US009192799B2

(12) United States Patent
Alenaddaf

(10) Patent No.: US 9,192,799 B2
(45) Date of Patent: Nov. 24, 2015

(54) FOLDABLE EXERCISE APPARATUS

(71) Applicant: Daniel Alenaddaf, Moldendinar (AU)

(72) Inventor: Daniel Alenaddaf, Moldendinar (AU)

(73) Assignee: Australian Fitness Supplies PTY Ltd, Molendinar, QL (AU)

( * ) Notice: Subject to any disclaimer, the term of this patent is extended or adjusted under 35 U.S.C. 154(b) by 32 days.

(21) Appl. No.: 13/755,632

(22) Filed: Jan. 31, 2013

(65) Prior Publication Data

US 2014/0243174 A1 Aug. 28, 2014

(51) Int. Cl.

| | |
|---|---|
| ***A63B 26/00*** | (2006.01) |
| ***A63B 17/00*** | (2006.01) |
| ***A63B 71/00*** | (2006.01) |
| ***A63B 21/00*** | (2006.01) |
| ***A63B 23/12*** | (2006.01) |
| *A63B 71/02* | (2006.01) |

(52) U.S. Cl.

CPC ..... *A63B 17/00* (2013.01); *A63B 21/00047* (2013.01); *A63B 21/1457* (2013.01); *A63B 23/1218* (2013.01); *A63B 71/0036* (2013.01); *A63B 2071/025* (2013.01); *A63B 2210/50* (2013.01)

(58) Field of Classification Search

CPC ..... A63B 17/00; A63B 71/0036; A63B 21/00047; A63B 21/078; A63B 21/1457; A63B 23/1218

USPC ..... 482/92–104, 106–108, 133–135, 142; 248/225.21, 304, 308, 339, 340

See application file for complete search history.

(56) References Cited

U.S. PATENT DOCUMENTS

| | | | | |
|---|---|---|---|---|
| 3,874,657 | A * | 4/1975 | Niebojewski | 482/104 |
| 4,898,381 | A * | 2/1990 | Gordon | 482/103 |
| 4,928,961 | A * | 5/1990 | Madden | 482/104 |
| 6,299,568 | B1 | 10/2001 | Prok | |
| 6,685,601 | B1 * | 2/2004 | Knapp | 482/104 |
| 7,651,443 | B1 * | 1/2010 | Fenster et al. | 482/37 |
| 2002/0091043 | A1 | 7/2002 | Rexach | |
| 2009/0181833 | A1 * | 7/2009 | Cassidy et al. | 482/94 |

OTHER PUBLICATIONS

International Search Report in related PCT Application No. PCT/IB2014/001010, mailed Sep. 3, 2014.

* cited by examiner

*Primary Examiner* — Oren Ginsberg
*Assistant Examiner* — Nyca T Nguyen
(74) *Attorney, Agent, or Firm* — Troutman Sanders LLP; Ryan A. Schneider; Benjamin C. Wiles

(57) ABSTRACT

A foldable exercise apparatus having a rigid frame back wall with hinged rigid frame side walls with one of the side walls having a hinged cross brace that is fastenable to the opposing side wall. Also provided is a collapsible bench attachable to the exercise apparatus in its folded state. Further provided are wheels, with each wheel mounted to a respective side wall front end to aid in deploying and folding the side walls. The exercise apparatus rigid frame provides a plurality of exercise equipment apertures to support the storage of exercise equipment components until needed.

13 Claims, 8 Drawing Sheets

FOLDABLE EXERCISE APPARATUS

BACKGROUND OF THE INVENTION

1. Field of the Invention

The present invention relates generally to exercise equipment and, more specifically, to a foldable exercise apparatus comprising a frame having a rigid frame back wall with hinged rigid frame side walls with one of said side walls having a hinged cross brace, which serves as structural support and exercise equipment, such as chin ups and pull ups, that is fastenable to the opposing side wall. Also provided is a foldable bench attachable to the exercise apparatus in its folded state. Further provided are wheels mounted to a respective side wall front end to aid in deploying and folding the side walls.

Additionally provided are a plurality of exercise equipment receptacles supporting the storage of exercise equipment components until needed.

2. Description of the Prior Art

There are other exercise machines which provide for compact storage. While these exercise machines may be suitable for the purposes for which they where designed, they would not be as suitable for the purposes of the present invention as heretofore described.

It is thus desirable to provide an exercise apparatus having a rigid frame back wall with hinged rigid frame side walls that are pivotal from a folded state to a deployed state incorporating a pivotal overhead brace and side-wall base mounted wheels.

It is further desirable to provide a foldable bench that is attachable to the exercise apparatus in its folded state.

SUMMARY OF THE PRESENT INVENTION

A primary object of the present invention is to provide an exercise apparatus that is foldable when not in use.

Another object of the present invention is to provide an exercise apparatus having a tubular frame back wall and hinged tubular frame sidewalls.

Yet another object of the present invention is to provide a back wall having transverse feet on the bottom corners and transverse beams extending from the top corners having side walls pivotally attached thereto.

Still yet another object of the present invention is to provide said back wall with top and bottom end transverse beams fixedly attached a stanchion having a slide able collar and bar for selectively attaching weights to said bar.

An additional object of the present invention is to provide a cable attached to the stanchion's slide able weight bar then threaded over front and back side pulleys terminating in an overhead handle bar for moving the slide able weight bar along said stanchion.

A further object of the present invention is to provide an apparatus wherein said tubular frame sidewall hinge is a pair of pivot pins extending between said side walls and the back wall's feet and beams.

A yet further object of the present invention is to provide an apparatus where a respective sidewall pivot pins are spaced from the back wall so that one sidewall folds substantially flat against the back wall while the other folds substantially against the folded side wall.

A still yet further object of the present invention is to provide an exercise apparatus having a sidewall-hinged overhead support having a distal end receptacle so that when pivoted to its open state the receptacle is placed over the opposing sidewall frame securing the exercise apparatus in an open state.

Another object of the present invention is to provide a tubular frame back wall and side walls having a plurality of receptacle for storing exercise equipment components until needed.

Yet another object of the present invention is to provide a plurality of releasable tensioned fasteners for securing the exercise apparatus in a desired open or closed state.

Still yet another object of the present invention is to provide a tensioned safety fastener having a handle and post forming an integral part of the back wall top end transverse beams.

An additional object of the present invention is to provide an aperture within each sidewall so that the safety fastener post member is seatable within a respective sidewall aperture securing the sidewall in an open position.

Another object of the present invention is to provide a releasable tensioned fastener forming an integral part of a sidewall with the fastener post portion seatable in an aperture within the overhead support for securing the overhead support in a locked state.

Yet another object of the present invention is to provide a free standing bench having an adjustable seat portion and back portion fixed to a rigid frame.

Still yet another object of the present invention is to provide a free standing bench with a rigid frame having a footer with a pair of apertures so that the bench can be fastened to the exercise apparatus overhead hangers when in a closed state.

Additional objects of the present invention will appear as the description proceeds.

The present invention overcomes the shortcomings of the prior art by providing a foldable exercise apparatus having a rigid frame back wall with hinged rigid frame side walls with one of said side walls having a hinged cross brace that is fastenable to the opposing side wall. Also provided is a collapse able bench attachable to the exercise apparatus in its folded state. Further provided are wheels mounted to a respective side wall front end to aid in deploying and folding the side walls. The exercise apparatus rigid frame provides a plurality of exercise equipment receptacles supporting the storage of exercise equipment components until needed.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
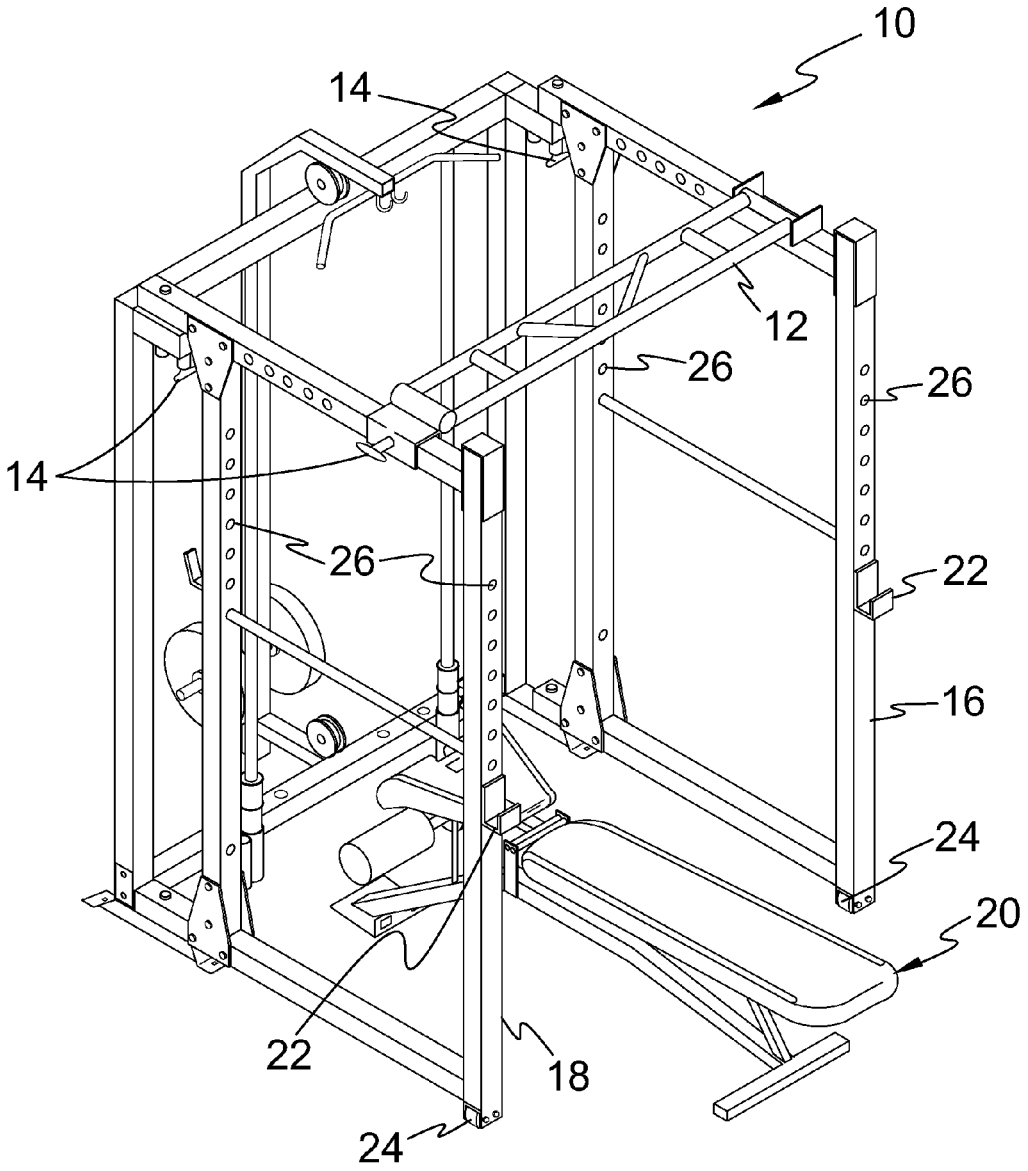
FIG. 1 is an illustrative perspective view of the foldable exercise apparatus of the present invention.

Turning now descriptively to the drawings, in which similar reference characters denote similar elements throughout the several views, the Figures illustrate the foldable exercise apparatus of the present invention. With regard to the reference numerals used, the following numbering is used throughout the various drawing figures.

10 foldable exercise apparatus
12 cross brace of apparatus 10
14 quick release safety lock of apparatus 10
16 first rigid frame side wall of apparatus 10
18 second rigid frame side wall of apparatus 10
20 collapsible bench of apparatus 10
22 storage hook on first and second rigid frame side walls 16, 18
24 wheel on first and second rigid frame side walls 16, 18
26 aperture in first and second rigid frame side walls 16, 18
28 rigid frame back wall of apparatus 10
30 footer on lower end of rigid frame back wall 28
32 pivot pin of apparatus 10
34 transverse beam on upper end of rigid frame back wall 28
36 free end of cross brace 12
38 receptacle in free end 36
40 front leg of bench 20
42 rear leg of bench 20
44 platform on front leg 40
46 opening in platform 44
48 bench hanger on apparatus 10

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

Referring to FIG. 1, shown is an illustrative perspective view of the foldable exercise apparatus of the present invention. The present invention is a foldable exercise apparatus 10 having a hinged cross brace 12, quick release safety locks 14, folding side walls 16, 18, collapsible bench 20, storage hooks 22 and wheels 24 while a plurality of apertures 26 are for storing exercise equipment components until needed.

Figure 2:
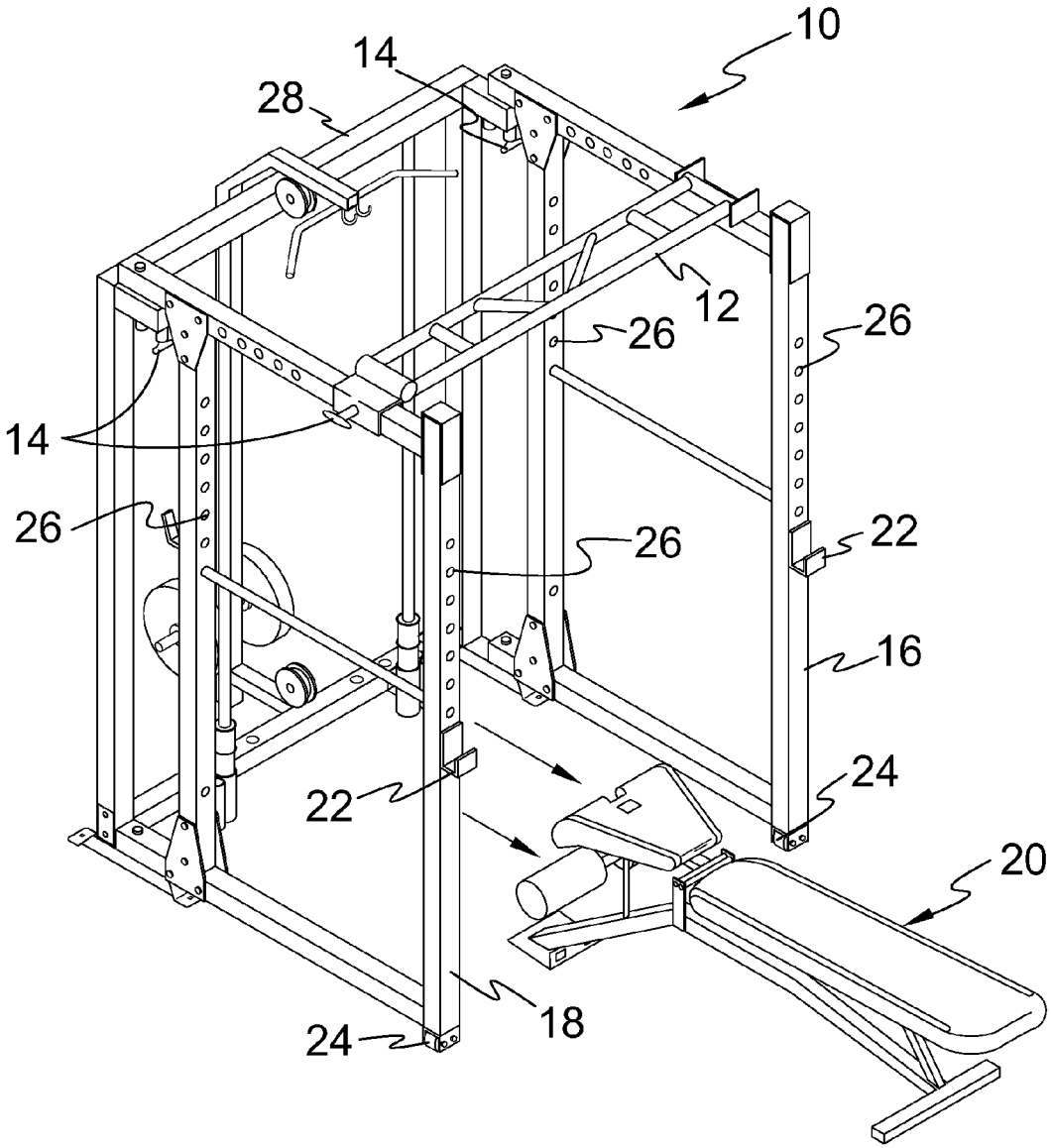
FIG. 2 is an illustrative perspective view of the exercise apparatus of the present invention.

Referring to FIG. 2, shown is an illustrative perspective view of the exercise apparatus of the present invention. The present invention is a foldable exercise apparatus 10 comprising a rigid frame back wall 28 with hinged rigid frame side walls 16, 18 with the first side wall 16 having a hinged cross brace 12, which serves as a structural support and exercise component that is fastenable to the second side wall 18. Also provided is a collapsible bench 20 attachable to the exercise apparatus 10 in its folded state that when detached from the exercise apparatus 10 can be selectively positioned as needed to perform a plethora of exercises provided by the foldable exercise apparatus 10.

Figure 3:
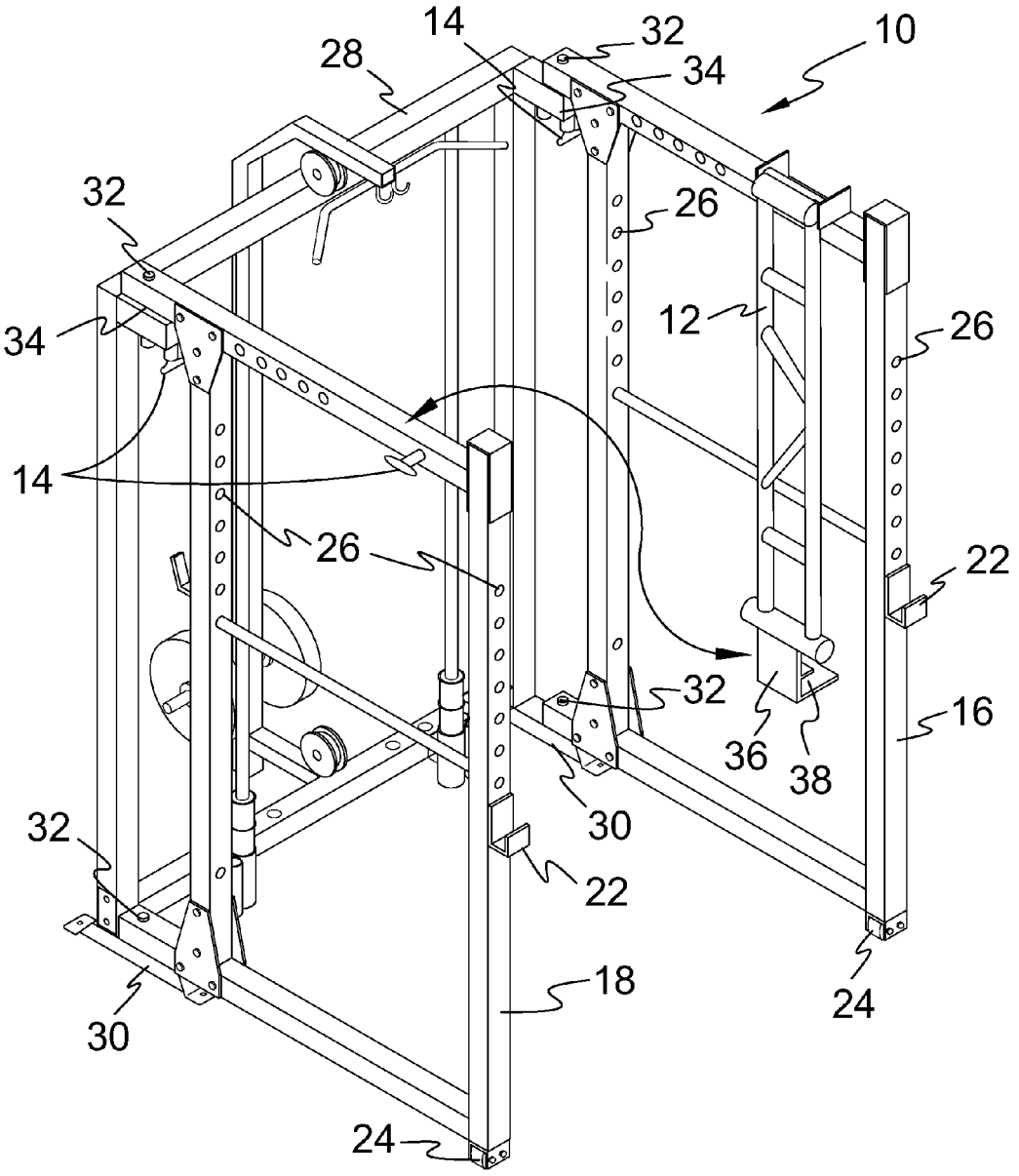
FIG. 3 is an illustrative perspective view of the exercise apparatus of the present invention.

Referring to FIG. 3, shown is an illustrative perspective view of the exercise apparatus of the present invention. The foldable exercise apparatus 10 of the present invention provides a rigid frame back wall 28 having opposing side footers 30 incorporating a pivot pin 32 and back wall transverse beams 34 incorporating a pivot pin 32 having respective side walls 16, 18 supported by a respective pair of upper and lower pivot pins 32. Also provided is a hinged cross brace 12 fastened to the top of the first side wall 16 with a free end 36 having a receptacle 38 for engaging the second side wall 18 and a quick release safety lock 14 for then locking the cross brace 12 to the second side wall 18. The fastened hinged cross brace 12 locks the positioning of the side walls 16, 18 and also serves as an exercise component for chin-ups and pull-ups.

Figure 4:
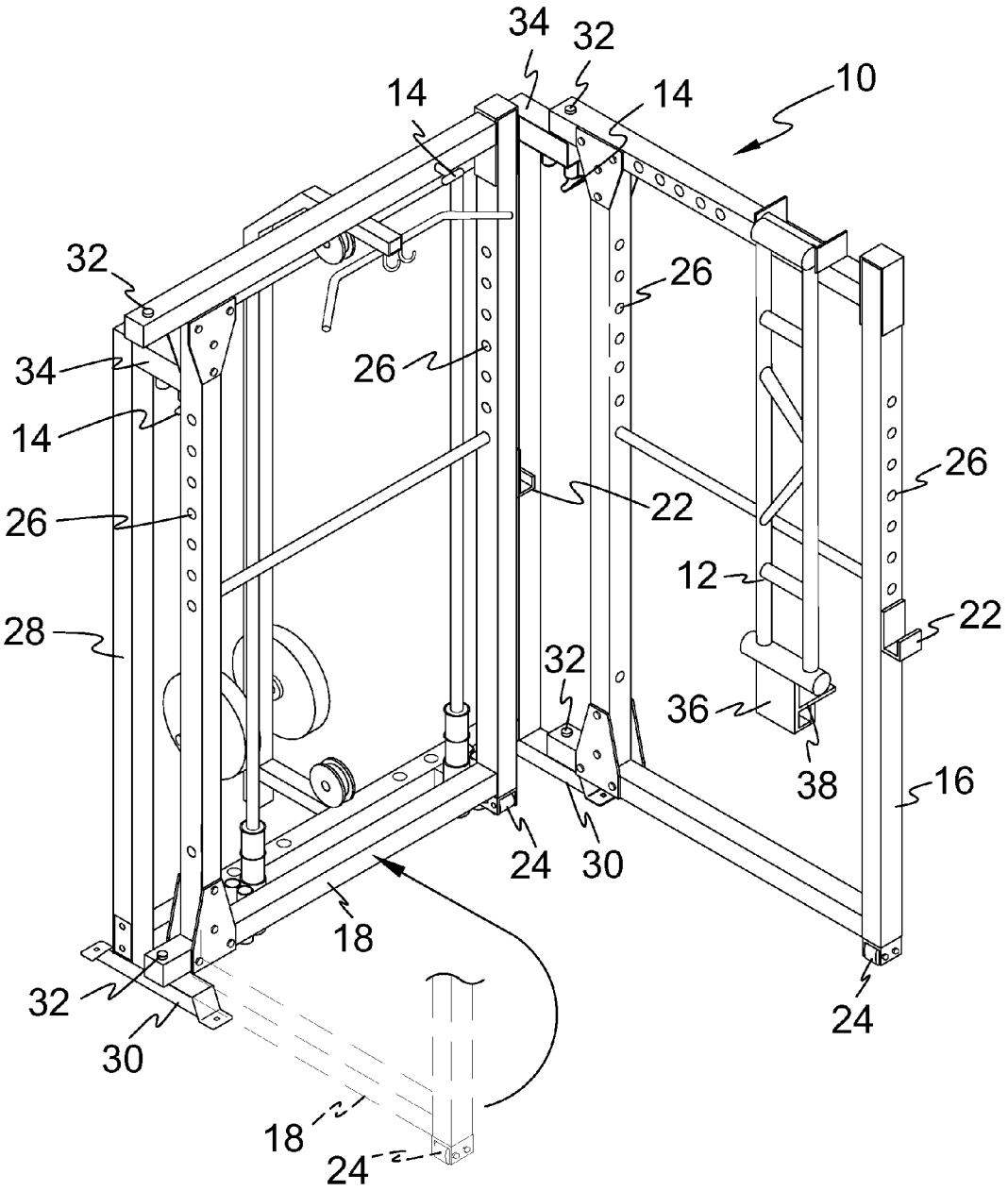
FIG. 4 is an illustrative perspective view of the folding procedure for the foldable exercise apparatus.

Referring to FIG. 4, shown is an illustrative perspective view of the folding procedure for the foldable exercise apparatus. To fold the exercise apparatus 10 for storage, the quick release safety lock 14 holding the hinged cross brace 12 is retracted to its stop position releasing the second side wall 18 which also has a quick release safety lock 14 that is disengaged allowing the second side wall 18 to be pivoted out of the way while the hinged cross brace 12 is moved to its stored position, where then the second side wall 18 is pivoted to its storage position against the back wall 28.

Figure 5:
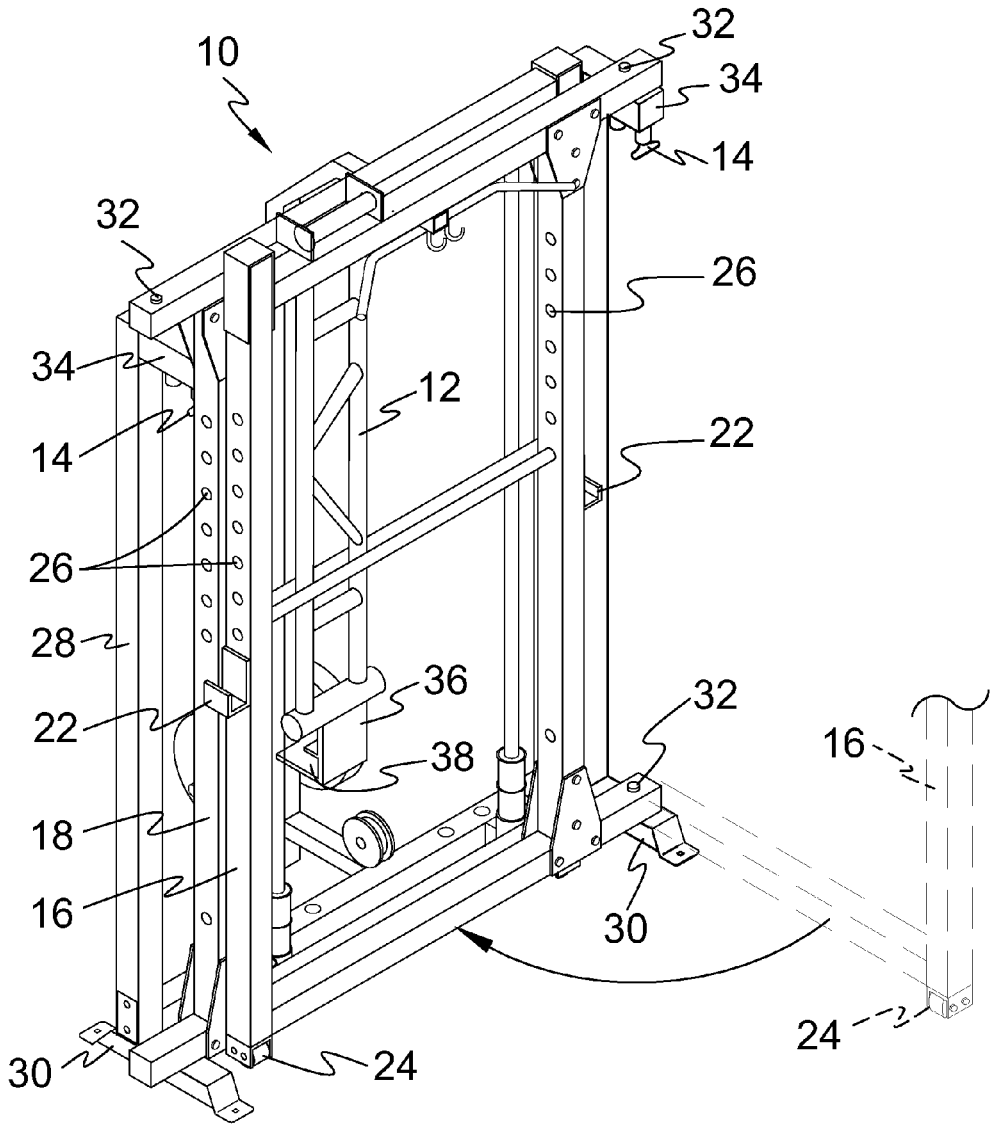
FIG. 5 is an illustrative perspective view of the folding procedure for the foldable exercise apparatus.

Referring to FIG. 5, shown is an illustrative perspective view of the folding procedure for the foldable exercise apparatus. As aforementioned, to fold the exercise apparatus 10 for storage, the quick release safety lock 14 holding the hinged cross brace 12 is retracted to its stop position releasing the second side wall 18, which also has a quick release safety lock 14 that is disengaged allowing the second side wall 18 to be pivoted out of the way while the hinged cross brace 12 is moved to its stored position, where then the second side wall 18 is pivoted to its storage position against the back wall 28. The quick release safety lock 14 for the first side wall 16 is disengaged from the back wall transverse beam 34 allowing the first side wall 16 to be folded, thereby providing the foldable exercise apparatus 10 of the present invention to be completely folded.

Figure 6:
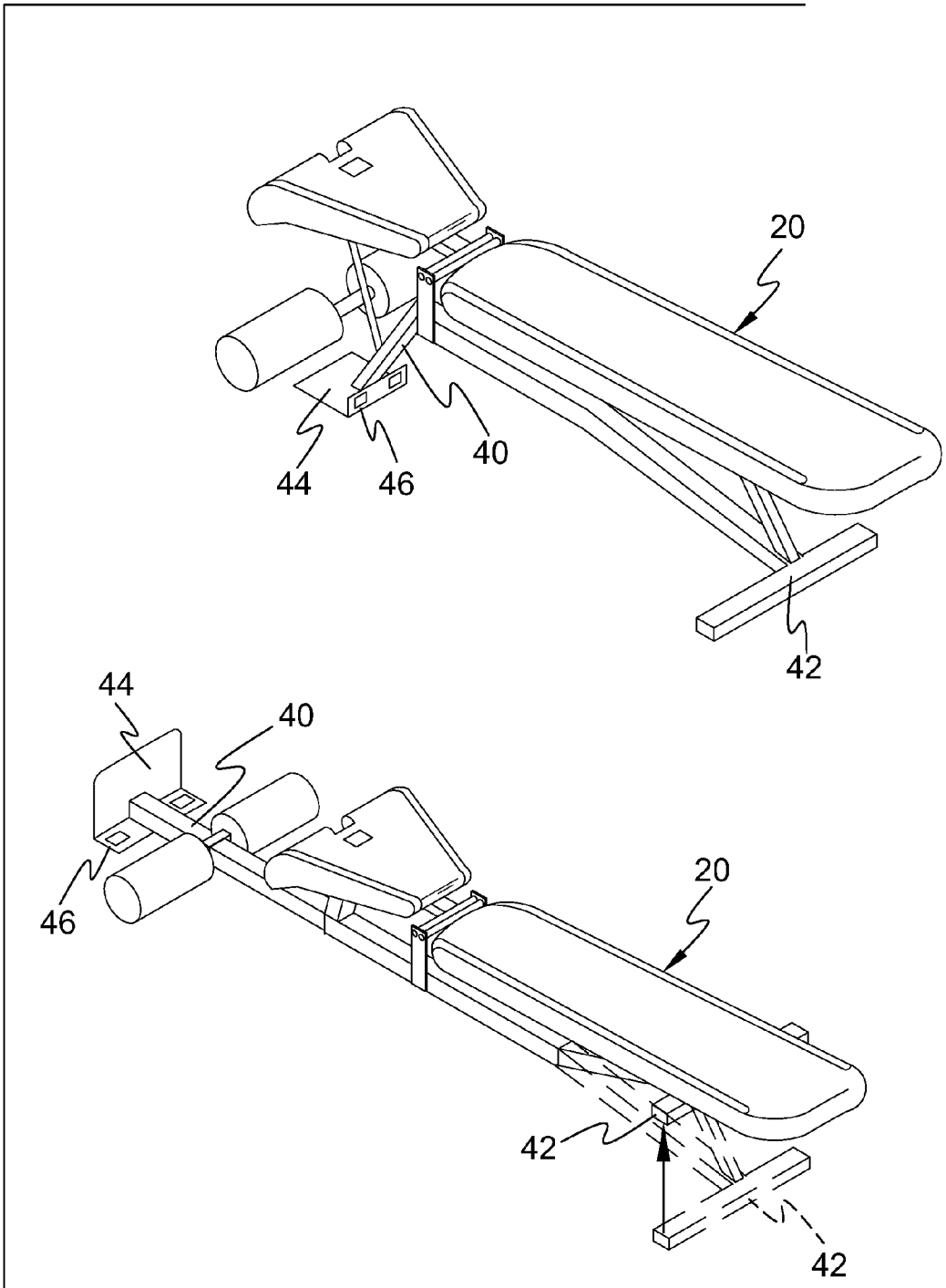
FIG. 6 is an illustrative perspective view of the collapsible bench of the exercise apparatus of the present invention.

Referring to FIG. 6, shown is an illustrative perspective view of the collapsible bench of the exercise apparatus of the present invention. Depicted is the collapsible exercise bench 20 of the present invention having a pivotal front leg 40 and rear leg 42 that fold to a substantially flat state with the front leg 40 having a platform 44 with a pair of openings 46, so that the bench 20 can be attached to bench hangers 48 of the exercise apparatus 10.

Figure 7:
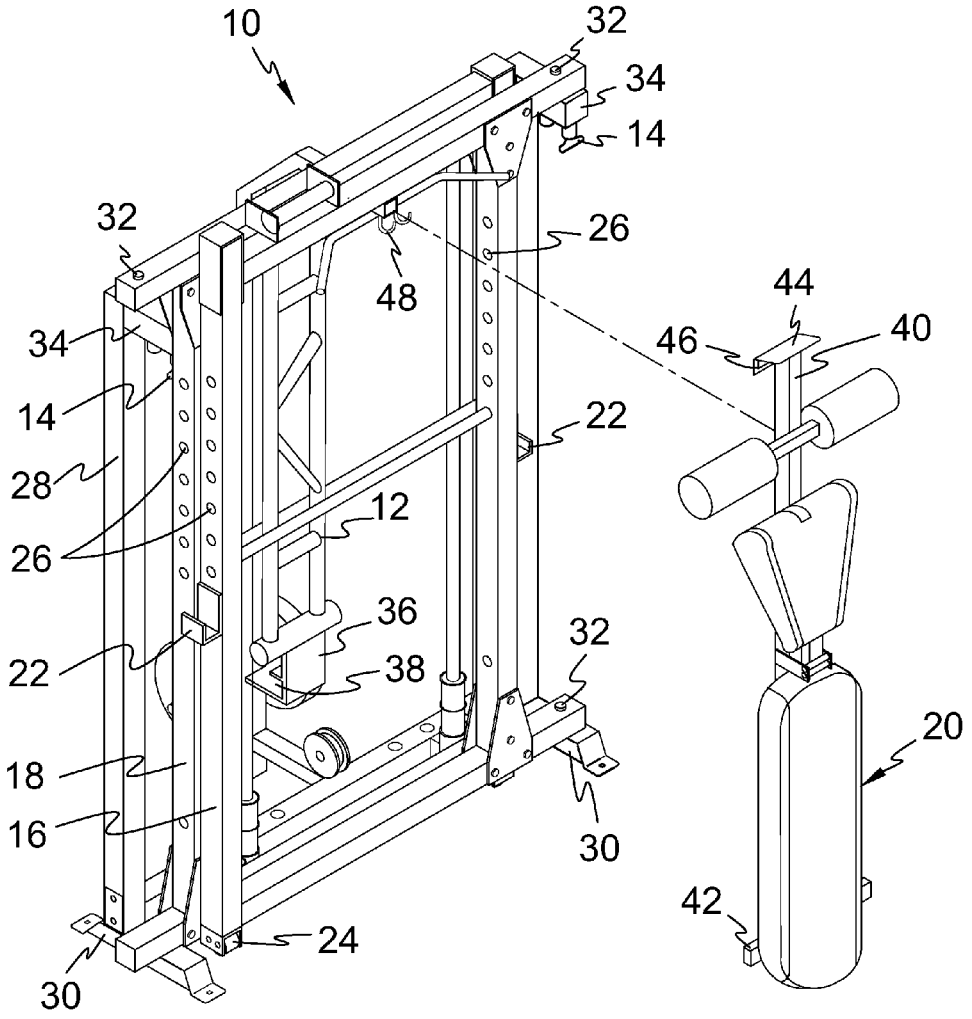
FIG. 7 is an illustrative perspective view of the collapsible bench of the exercise apparatus of the present invention.

Referring to FIG. 7, shown is an illustrative perspective view of the collapsible bench of the exercise apparatus of the present invention. After the exercise bench 20 is collapsed the front leg platform 40 has a pair of openings 42 so that the bench 20 can be attached to bench hangers 48 on the exercise apparatus 10.

Figure 8:
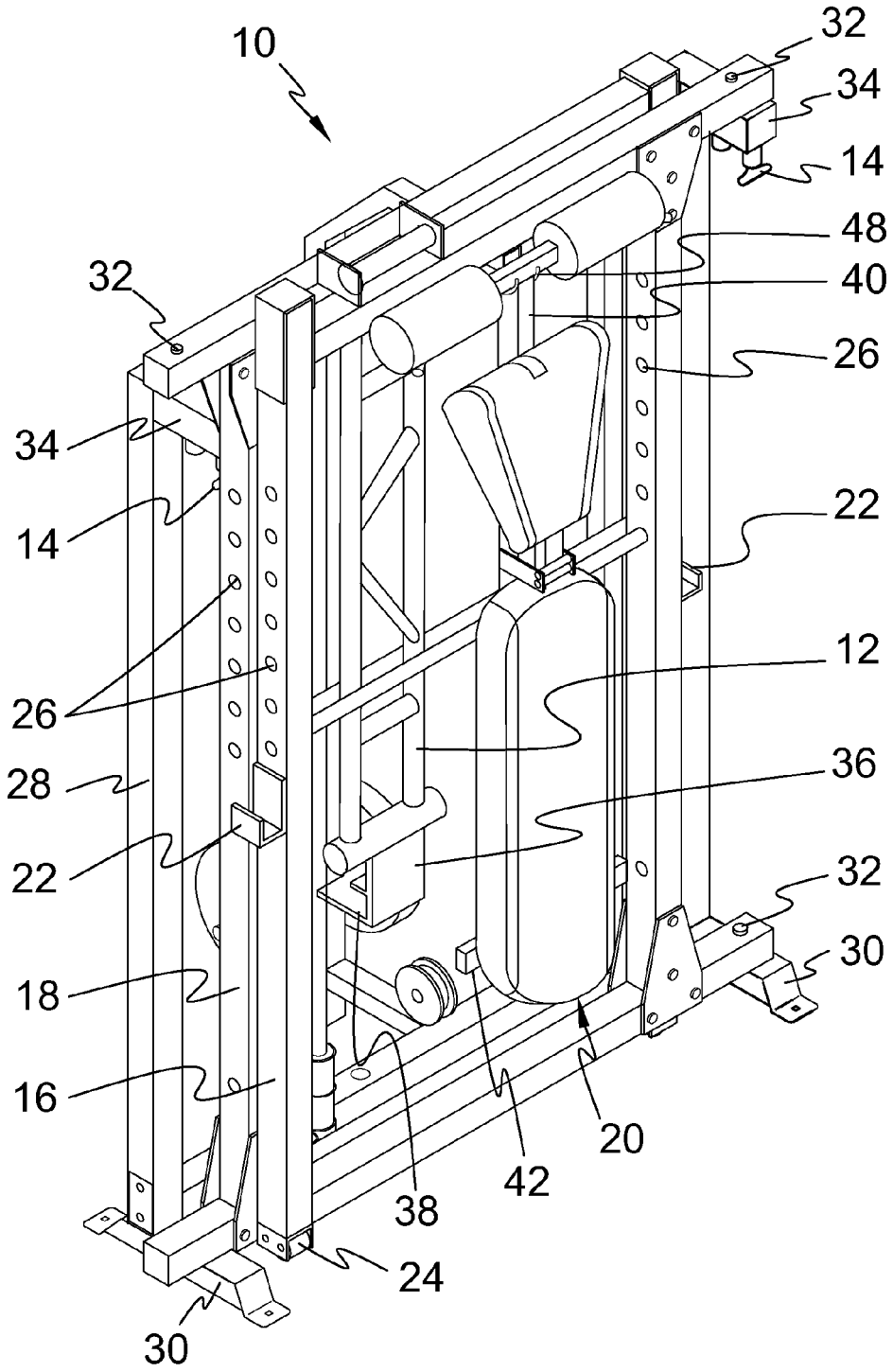
FIG. 8 is an illustrative perspective view of the folded exercise apparatus of the present invention.

Referring to FIG. 8, shown is an illustrative perspective view of the folded exercise apparatus of the present invention. The present invention is a foldable exercise apparatus 10 having a hinged cross brace 12, quick release safety locks 14, folding side walls 16, 18, collapsible bench 20, storage hooks 22 and wheels 24, while a plurality of apertures 26 are for storing exercise equipment components until needed.

What is claimed is:

1. A foldable exercise apparatus comprising:

a rigid frame back wall;

a first rigid frame side wall pivotally mounted to the rigid frame back wall;

a second rigid frame side wall pivotally mounted to the rigid frame back wall;

a cross brace having an end hinged to a top portion of the first rigid frame side wall, while a free end of the cross brace is adapted to be fastened to a top portion of the second rigid frame side wall, whereby the cross brace can serve as a structural support and an exercise component;

a collapsible bench that can be selectively positioned as needed to perform a plethora of exercises, the collapsible bench comprising a pivotal front leg, a platform having a pair of openings on a distal end of the front leg, and a pivotal rear leg; and a bench hanger mounted near a top portion of the rigid frame back wall to engage with the openings in the platform of the collapsible bench for storage when not in use.

2. The apparatus of claim 1 further comprising:

a pair of footers, in which each footer is mounted transversely to an underside of one lower end of the rigid frame back wall;

a pair of transverse beams, in which each transverse beam is mounted at an upper end of the rigid frame back wall;

three quick release safety locks, in which the first lock is located at an underside of the first transverse beam, the second lock is located at an underside of the second transverse beam, while the third lock is located at the top portion of the second rigid frame side wall to engage with the free end of the cross brace; and four pivot pins, in which two of the pivot pins extend through the first rigid frame side wall into the first footer and the first transverse beam of the rigid frame back wall, while two other of the pivot pins extend through the second rigid frame side wall into the second footer and the second transverse beam of the rigid frame back wall, whereby the first rigid frame side wall and the second rigid frame side wall can fold against the rigid frame back wall for storage.

3. The apparatus of claim 2 further comprising a pair of wheels, in which the first wheel is rotatably mounted to a lower free end of the first rigid frame side wall, while the second wheel is rotatably mounted to a lower free end of the second rigid frame side wall, to thereby help the first rigid frame side wall and the second rigid frame side wall to fold against the rigid frame back wall for storage.

4. The apparatus of claim 2, wherein the free end of the cross brace comprises a receptacle for engaging with the top portion of the second rigid frame side wall, whereby the third quick release safety lock can lock within the receptacle of the cross brace.

5. The apparatus of claim 1 further comprising a plurality of storage hooks, in which the storage hooks are affixed to upright portions of the first rigid frame side wall and the second rigid frame side wall to store exercise equipment by the storage hooks until needed.

6. The apparatus of claim 5, wherein the upright portions of the first rigid side wall and the second rigid frame side wall have a plurality of apertures therethrough.

7. A foldable exercise apparatus comprising:

a rigid frame back wall;

a first rigid frame side wall pivotally mounted to the rigid frame back wall;

a second rigid frame side wall pivotally mounted to the rigid frame back wall;

a cross brace having a first end and a second end, the first end hinged to a top portion of the first rigid frame side wall and the second end is adapted to be fastened to a top portion of the second rigid frame side wall;

a bench hanger mounted near a top portion of the rigid frame back wall to engage with openings in a platform of a collapsible bench for storage when not in use;

a first and second footer, each footer mounted transversely to an underside of a bottom portion of the rigid frame back wall;

a first and second transverse beam, each transverse beam mounted at the top portion of the rigid frame back wall;

a first quick release safety lock located at an underside of the first transverse beam;

a second quick release safety lock located at an underside of the second transverse beam;

a third quick release safety lock located at the top portion of the second rigid frame side wall and configured to engage with the second end of the cross brace;

a first and second pivot pin, the first and second pivot pins extending through the first rigid frame side wall into the first footer and the first transverse beam of the rigid frame back wall; and a third and fourth pivot pin, the third and fourth pivot pins extending through the second rigid frame side wall into the second footer and the second transverse beam of the rigid frame back wall;

wherein the first and second rigid frame side walls can fold against the rigid frame back wall for storage.

8. The apparatus of claim 7 further comprising a plurality of storage hooks, the storage hooks affixed to upright portions of the first rigid frame side wall and the second rigid frame side wall.

9. The apparatus of claim 8, wherein the upright portions of the first rigid side wall and the second rigid frame side wall comprise a plurality of apertures therethrough.

10. The apparatus of claim 7 further comprising a collapsible bench configured to be selectively positionable.

11. The apparatus of claim 10, wherein the collapsible bench comprises:

a pivotal front leg;

a platform having a pair of openings on a distal end of the front leg; and a pivotal rear leg.

12. The apparatus of claim 7 further comprising:

a first wheel rotatably mounted to a bottom free end of the first rigid frame side wall; and a second wheel rotatably mounted to a bottom free end of the second rigid frame side wall;

wherein the first and second wheels assist the first rigid frame side wall and the second rigid frame side wall to fold against the rigid frame back wall.

13. The apparatus of claim 7, wherein the third quick release safety lock is lockable within a receptacle of the cross brace.

* * * * *